US007694974B1

(12) United States Patent
Fowler-Gehring et al.

(10) Patent No.: US 7,694,974 B1
(45) Date of Patent: Apr. 13, 2010

(54) QUESTION-AND-ANSWER GAME

(75) Inventors: Carie S. Fowler-Gehring, Benzonia, MI (US); Debbie L. Fowler, Frankfort, MI (US)

(73) Assignee: Savvy Ideas, LLC, Benzonia, MI (US)

( * ) Notice: Subject to any disclaimer, the term of this patent is extended or adjusted under 35 U.S.C. 154(b) by 252 days.

(21) Appl. No.: 11/767,888

(22) Filed: Jun. 25, 2007

(51) Int. Cl.
*A63F 1/00* (2006.01)

(52) U.S. Cl. ..... 273/429

(58) Field of Classification Search ..... 273/429–432
See application file for complete search history.

(56) References Cited

U.S. PATENT DOCUMENTS 5,746,431 A * 5/1998 McIntyre et al. ..... 273/247
5,882,008 A * 3/1999 Siegesmund ..... 273/249
6,497,412 B1 * 12/2002 Bramm ..... 273/430
7,331,857 B2 * 2/2008 MacIver ..... 463/9
7,351,149 B1 * 4/2008 Simon et al. ..... 463/42
7,396,014 B2 * 7/2008 Jenkins ..... 273/242
2005/0073096 A1 * 4/2005 Reynolds ..... 273/248
2007/0007729 A1 * 1/2007 Jenkins ..... 273/430

OTHER PUBLICATIONS

The Newlywed Game, Instructions & Question Book, http://www.endlessgames.com/instr/newlywed.pdf. 1998.*
The Friendship Newlywed Game, http://www.diva-girl-parties-and-stuff.com/friendship-newlywed-game.html, 2006.*

* cited by examiner

*Primary Examiner*—William M Pierce
(74) *Attorney, Agent, or Firm*—Northern Michigan Patent Law, PLC

(57) ABSTRACT

A question-and-answer game in which teams of two players are divided into two sets of teammates, and one set of teammates is isolated while the other set of teammates is asked one or more questions about their isolated teammates or about themselves and are designed to elicit how well they know each other. The isolated teammates return, are asked the same questions, and their answers/guesses are compared to their teammates' guesses/answers. In a first round, the questions are asked and answered in open forums where discussion is permitted. In a second round, the questions are asked in a closed forum where discussion is limited or not permitted, and the responses of the isolated teammates are presented one at a time, and if not a match to their teammates' responses, the other teams have an opportunity to correctly match.

13 Claims, 5 Drawing Sheets

QUESTION-AND-ANSWER GAME

FIELD OF THE INVENTION

The present invention is in the field of question and answer games, in particular those games in which one teammate attempts to guess how another teammate will answer a question.

BACKGROUND OF THE INVENTION AND DESCRIPTION OF RELATED ART

Question-and-answer games for "breaking the ice" at parties and social gatherings are well known. These include games in which team partners ask each other questions from a set of cards designed to elicit how well the team partners know each other.

Perhaps the most famous of the how-well-do-you-know-your-partner games was "The Newlywed Game™", originally a television game show. The game was played by newlywed couples, with the wives being taken off stage for a first round while the husbands were asked questions that were often personal to their relationships with their wives. The wives were then brought back on stage, and asked for their answers to the same questions. Once the wife gave her answer, the husband revealed the answer that he previously gave, which was written on a card. A match for a question was worth a certain number of points. In the second round, the husbands were taken off stage and the question-and-answer process was repeated with a new set of questions. The television game was subsequently made into a card-based home party game, apparently played with the same question-and-answer format, but with couples facing each other in the same room while questions are read and answered.

A television variation on The Newlywed Game called "Who Knows You Best?" apparently used the same question-and-answer format, but the teams were composed of female best friends rather than newlyweds.

The present inventors have used The Newlywed Game/Who Knows You Best? question-and-answer format at their own "girlfriends" parties, but thought it could be improved upon for the unique nature of such social gatherings.

BRIEF SUMMARY OF THE INVENTION

The present invention is a question-and-answer game designed especially for all-female "girlfriends" gatherings. The questions and scoring are based on how well players know each other, but the game has a more sophisticated, less rigid, and ultimately more engaging interaction especially suitable for small groups of women players, and does not require the players to know their partners as well as newlyweds or best friends in order to have a good time.

In a party of players, impromptu teams of two persons each are first selected on whatever basis is mutually agreeable. Teammates are split up, with one-half of the teammates (hereafter referred to as the B teammates) leaving the room or otherwise being isolated from the other half (hereafter referred to as the A teammates). The A teammates remain to be presented with questions in two different question rounds, then the B teammates return to try to match what their A teammates' have written.

The first question round is an open forum, in which the A teammates may talk with one another freely, up to and including discussion about the questions and their responses if desired. Each A teammate ultimately writes or otherwise records her response to the question, in a manner that keeps the response hidden from her B teammate until an appropriate time.

The second question round is a closed forum, in which communication between the A teammates is limited or forbidden, with the A teammates recording their responses in a manner hidden not only from their B teammates, but also from the other A teammates. This tends to make it more difficult to get a match between the A and B teammates' responses, and heightens the competition among the teams. In the preferred form, the second question round has a single question.

The B teammates then return, and are presented with the first-round questions. Matches with their A teammates' responses results in a score (for example, points or tokens); mismatches receive no score.

The B teammates are then presented with the second-round question, with either the A or B teammate on each team revealing her response; the other teammate compares her response secretly. A match to her teammate's revealed response results in a score, and the sharing of her response with the other teams. In the event of a mismatch, however, she keeps her response secret, and the other teams have a chance to privately consult and attempt to match her still-secret response. This phase of the game creates competitive bonding between teammates as against the other teams, while again heightening the competition. In the preferred form of the game, the question and answer rounds are then repeated with the B teammates staying to be presented with new questions drawn from the Group 1 and Group 2 question cards, and the A teammates leaving and then returning to try to match their B teammates' responses.

The game method is preferably played with question cards, with answer cards on which the teammates initially presented with the questions write their responses, and with scoring tokens. In the preferred form, the answer cards are erasable and reusable. Other methods and apparatus for presenting questions and recording answers are also within the scope of the invention. It will also be understood that while the game is ideally played by small groups of adult women, it is possible to modify the question sets for different ages and sexes of players.

These and other features and advantages of the invention will become apparent upon further reading of the specification, in light of the accompanying drawings.

DETAILED DESCRIPTION OF THE INVENTION

Figure 1:
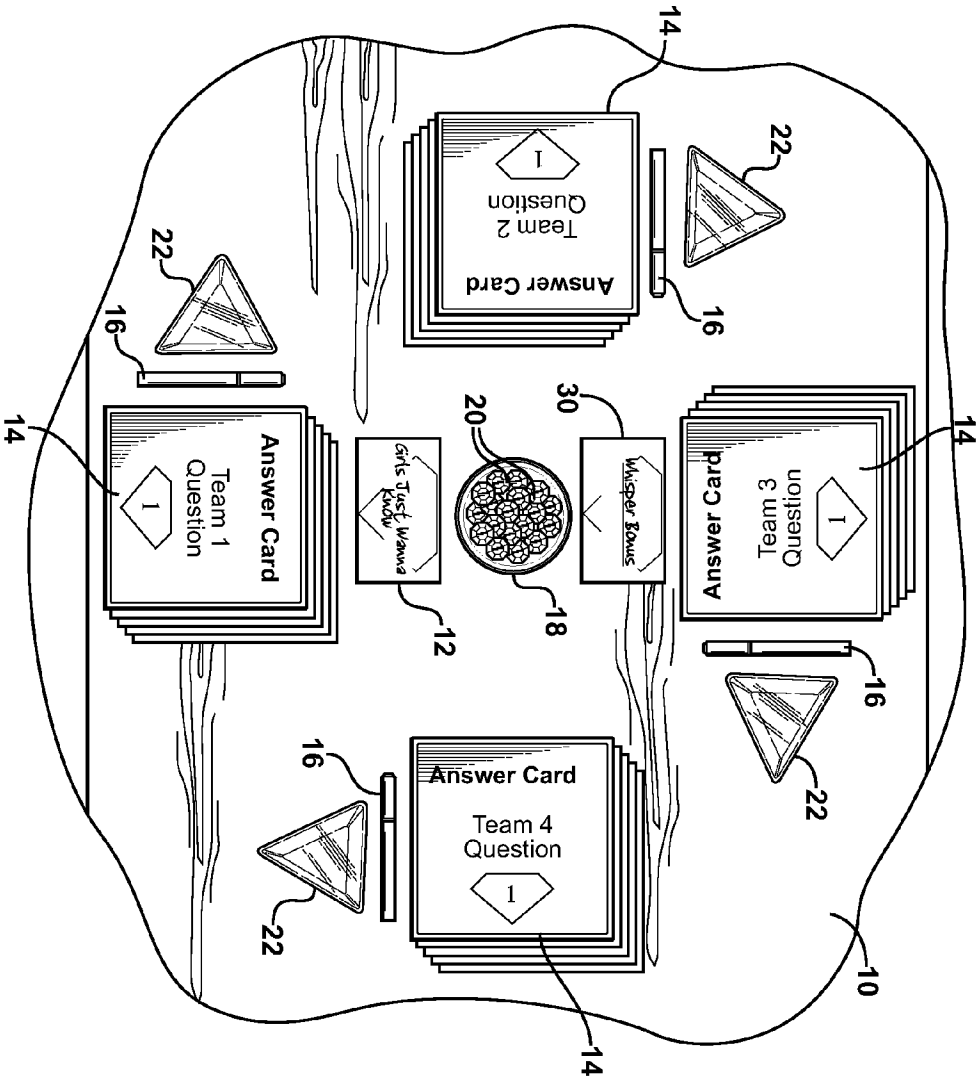
FIG. 1 is a plan view of preferred game pieces used to play the present invention, laid out on a table.

Referring first to FIG. 1, a basic set of preferred physical elements used to play the present game are shown schematically, set out on a table 10: A first set of question cards 12 with what will be referred to as "Group 1" questions, meant to be presented in an open forum; multiple sets 14 of dry-erase answer cards, one set for each team, the number of answer cards in each set 14 being equal to the number of Group 1 question cards 12 read in an open-forum round, plus the number of questions asked in a closed-forum bonus round (for example, four sets of six cards each, for four teams fielding four Group 1 questions plus one bonus question and possibly one Team bonus question); a dry erase marker 16 corresponding to each set of answer cards 14; a token holder 18 holding a plurality of scoring tokens 20; collection trays 22, one for each team, sized to hold several scoring tokens 20; and, a second set of question cards 30 with what will be referred to as "Group 2" questions meant to be presented in a closed-forum bonus round.

It will be understood that the number of teams, the corresponding sets of cards and accessories, and the number of questions asked in each round of play, can vary within the scope of the invention. The numbers chosen for this illustrated example are representative and preferred, but are not intended to limit the invention. It will also be understood that the terminology "Group 1" and "Group 2" used to describe the different types of questions is arbitrary and convenient for explanation of the game herein, and is not intended to be limiting.

It will also be understood that the form of the cards, the tokens, the trays and containers can vary, and the specific examples illustrated herein are the currently preferred forms, but are not intended to be limiting. Further, other apparatus and methods for presenting the questions, recording the responses, and keeping score will be apparent to those skilled in the art, and are possible, including but not limited to: handheld electronic question-retrieval and answer-recording devices and scorekeeping devices; or disposable rather than reusable question and answer cards and tokens; or computer-based or web-based interactive forums where questions are stored and retrieved, responses recorded and compared, and scores kept on the storage media of computers or servers; or even, as with the prior art The Newlywed Game, studio-assisted presentation of questions and recording of answers and scorekeeping.

Figure 1A:
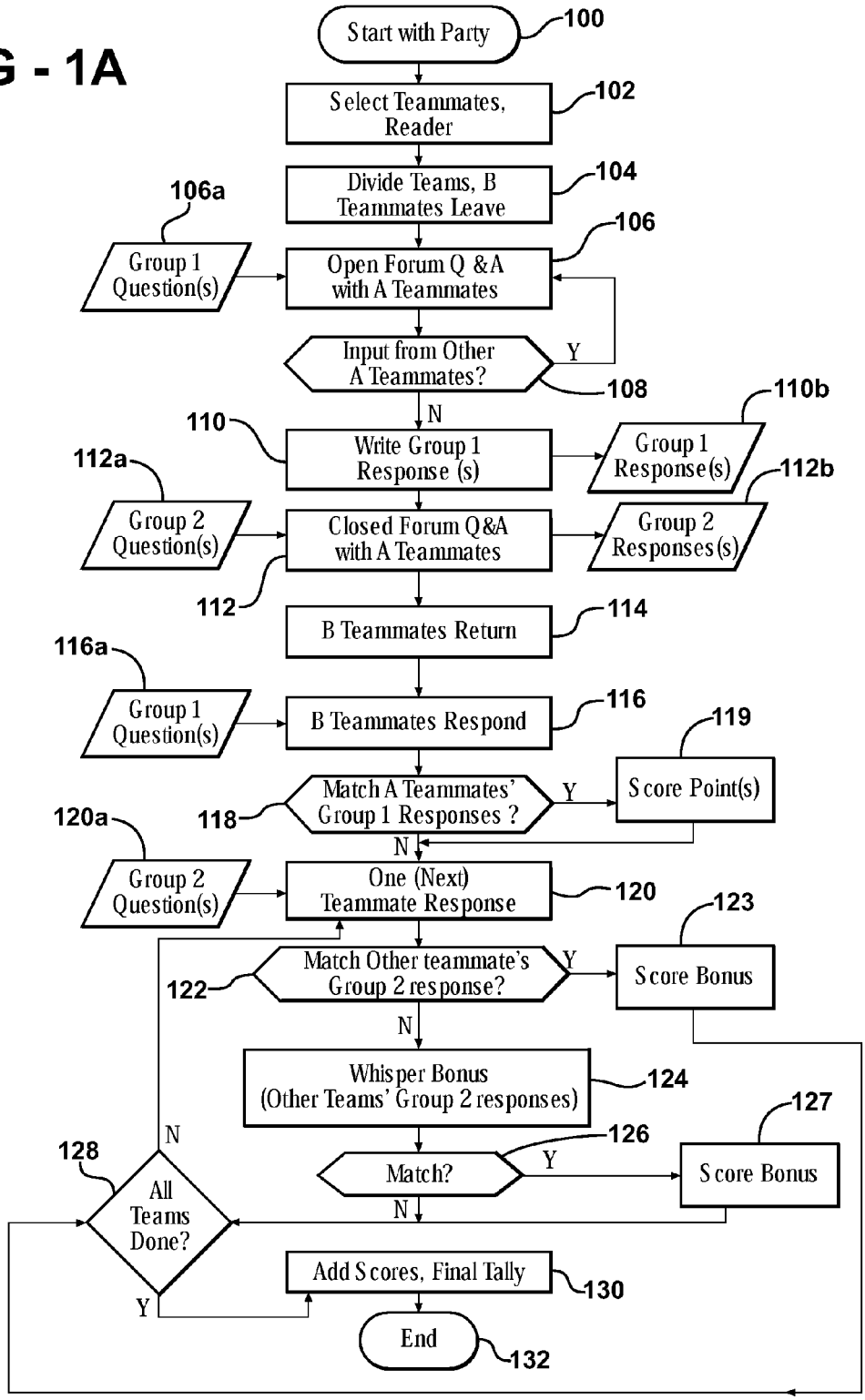
FIG. 1A is a schematic flowchart of a preferred method of playing the inventive game, using the pieces of FIG. 1.

FIG. 1A is a schematic flowchart of the basic and preferred game method, and will be referred to in conjunction with FIGS. 2-7 to help explain the flow of the game.

Figure 2:
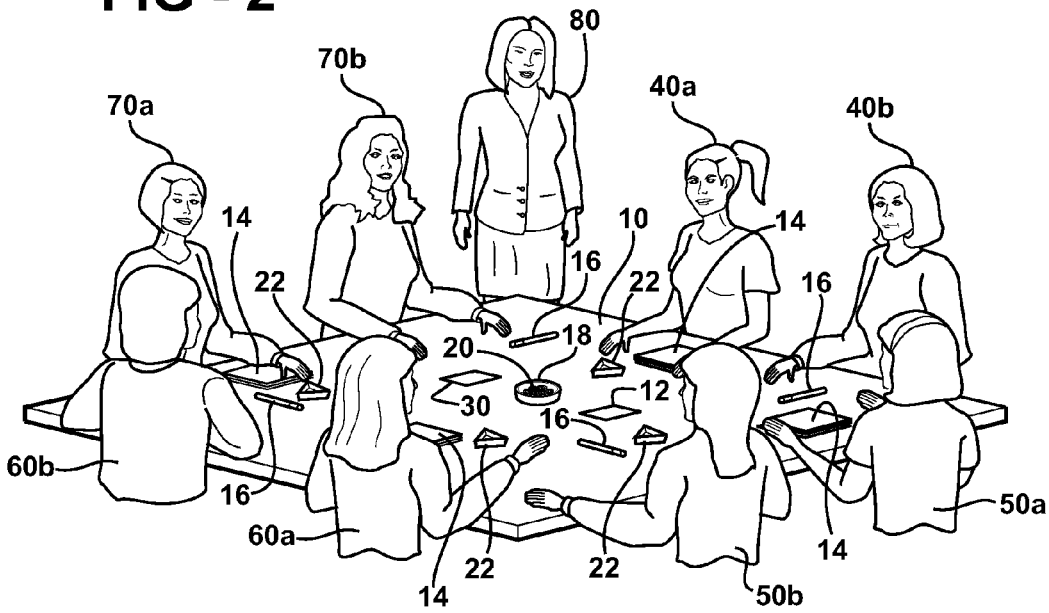
FIG. 2 is a perspective view of a party of women players at the table of FIG. 1, divided into teams.

Referring to FIGS. 1A and 2, a party of women players (step 100 in FIG. 1A), who are initially unpaired, are paired up into four teams numbered 40, 50, 60, and 70, of two players each (step 102). The preferred method of selecting teammates is mutual agreement by each teammate, although other methods can be used, including but not limited to random selection by a leader or by coin toss, dice-rolling, spinner, order of arrival at the gathering, age, the degree to which players know each other, etc. The flexibility of choosing teammates at the start of the game, from a party of people potentially relatively unknown to each other, or at least unequally known in terms of familial or other type of relationship, length of acquaintance, etc., creates a uniqueness and unpredictability to each game not possible with prior art games where all teams were inherently related and known to each other by virtue of the same type of relationship.

Each team is then divided into "A" and "B" teammates, for example 40*a*, 40*b*; 50*a*, 50*b*; 60*a*, 60*b*; and 70*a*, 70*b*, as shown in FIG. 2 (step 104). This A-B division is preferably decided by the teammates themselves, although other methods could be used. One person from the A teammates and one person from the B teammates can be selected to be the reader for each division's round of questions. Alternately, and as shown in FIG. 2 (step 102), if the party has an odd number of people or more people than can play the game at one time, a designated reader 80 can be selected from those not paired into teams. It will be understood that "A" and "B" are arbitrary and convenient designations for explaining herein how to differentiate the team members, and is not intended to be limiting; they could be called "first" and "second", or "gold" and "silver", for example.

Figure 3:
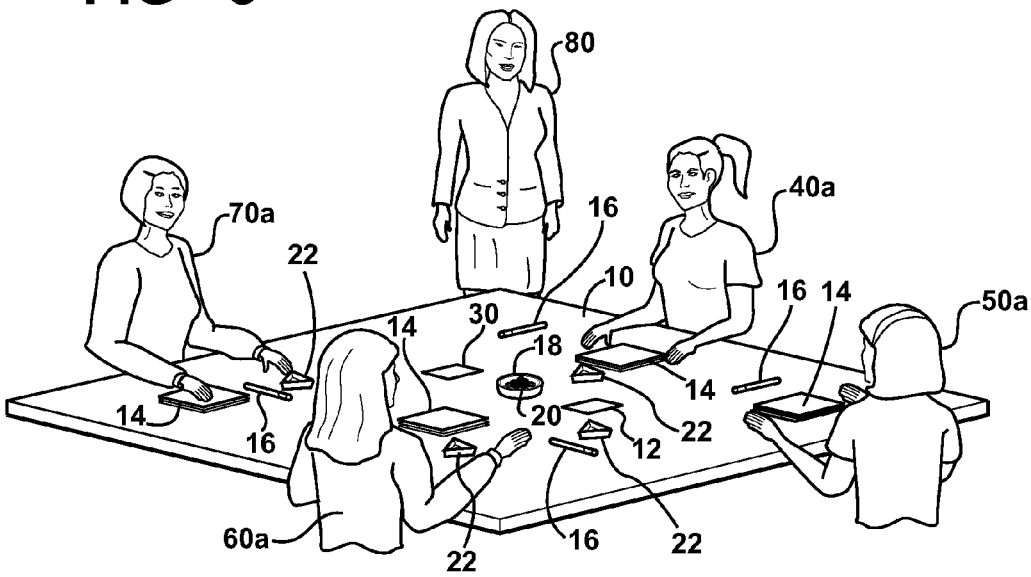
FIG. 3 is similar to FIG. 2, but with one set of teammates excused from the table, out of earshot.

Referring next to FIGS. 1A and 3, the B teammates 40*b*-70*b* leave, while the A teammates 40*a*-70*a* remain at table 10 (step 104) with answer cards 14. It will be understood that while leaving the room or otherwise walking out of earshot is the most common way for the B teammates to be isolated from the ensuing presentation of questions, other ways of isolating the B teammates from the A teammates at this stage of the game are possible and within the scope of the invention. For example, the B teammates could be asked to wear earplugs; or if the game were being played electronically among players communicating via video display or computer terminal, have their displays or monitors temporarily locked out or turned off.

Figure 4:
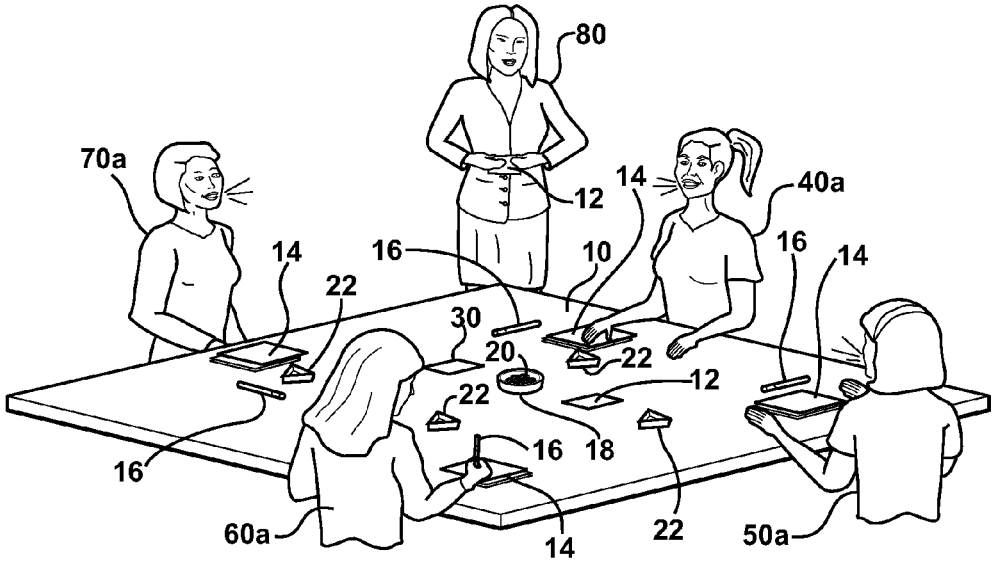
FIG. 4 is similar to FIG. 3, with a reader asking the remaining teammates a first-round question in an open forum.

Referring to FIGS. 1A and 4, once the B teammates are gone, the open-forum round of questions can begin (step 106). The reader 80 begins by drawing a card from the Group 1 set of question cards 12 (step 106*a*), and then reading the question printed on the back of the card, for example "Is your 'girlfriend' wearing nail polish on her toenails right now?". Conversation between the A players is allowed at this time, preferably without limit, up to and including discussion of the question and their responses (step 106). However, each A teammate 40*a*-70*a* must ultimately make her own decision (step 108) and write her own response on the back of her team's dry-erase answer card 14 for that question (step 110). Each answer card 14 is then set aside with the response hidden from view (output step 110*b*) so that the B teammates cannot see them when they return. There are preferably multiple Group 1 questions for this "open forum" round of play, for example four questions (with four correspondingly marked answer cards 14), although a single question would suffice.

The open forum round of play not only allows for a congenial and relaxing atmosphere that complements the social gathering, but also allows for game strategy and help including things such as discovering clues about certain B teammates from other players; or asking outright for information or opinions respecting a B teammate, depending on the desired or appropriate level of competition; or even using strategic deception based on knowledge of someone else's B teammate. The open forum thus allows the players to compensate for the varying levels of teammate knowledge inherent in on-the-spot teammate selection at a typical social gathering, especially where the game is used as an incidental entertainment or ice-breaker rather than the main focus of the gathering.

Figure 5:
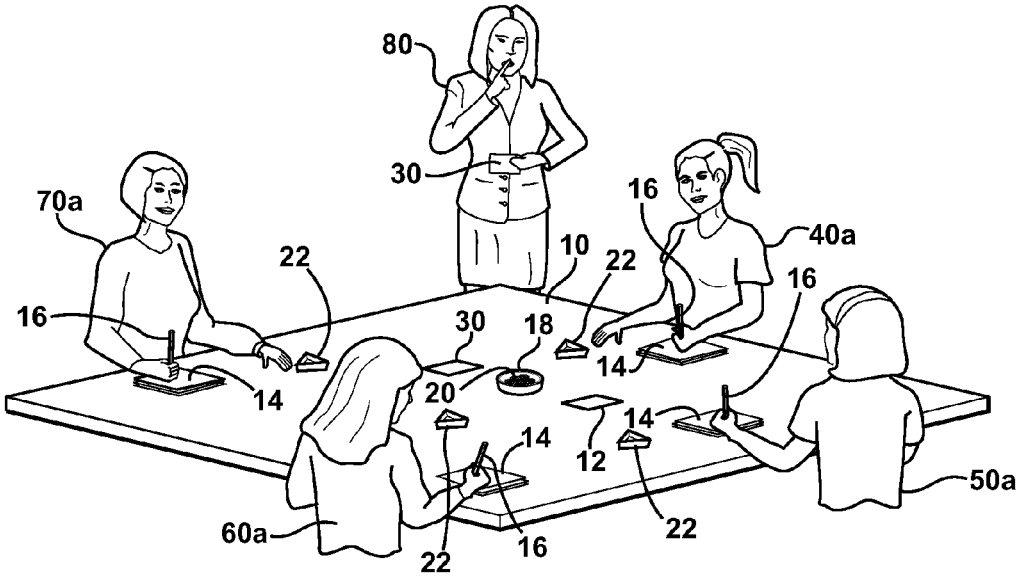
FIG. 5 is similar to FIG. 4, but with the reader asking the teammates a second-round question in a closed forum.

Referring next to FIGS. 1A and 5, the game enters a "closed forum" round of play (step 112), in which the reader 80 asks the A teammates 40*a*-70*a* one Group 2 question (step 112*a*) from the set of question cards 30 (a single Group 2 question is preferred, although the game can also be played with multiple Group 2 questions). The A teammates are not allowed to talk during this closed forum round of play, preferably not at all, and at a minimum not about the question(s) or their responses or their B teammates and their likely responses. The A teammates quietly write down their responses on the backs of correspondingly marked dry-erase answer cards included in the card sets 14, and set the cards aside (step 112*b*) with their responses hidden from view with respect to both the other A teammates and their returning B teammates. It will be understood that while it is preferred for the Group 2 question to be from a separate set of cards, and for the question to be structured so the A teammate will answer the question about herself, or the question to be of a different type (for example, more personal, more difficult, etc.) than the Group 1 questions, the Group 2 question could simply be another question of generally the same type and difficulty, and could even be drawn from the same deck or set of cards as the Group 1 questions, the most important difference being that it is asked in the closed forum.

Figure 6:
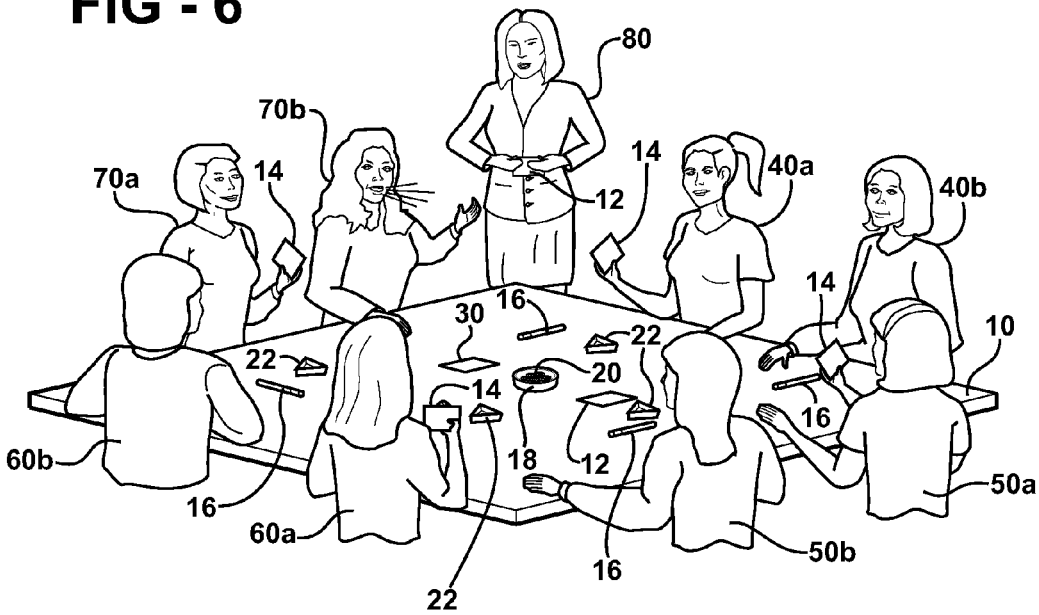
FIG. 6 shows the previously excused teammates returned to the table, and their responses to a first-round question being given.

Referring next to FIGS. 1A and 6, the B teammates 40*b*-70*b* are asked to return to the game forum (step 114), and the reader 80 asks them the Group 1 questions that were already heard by their A teammates (step 116*a*). In the preferred method, the B teammate gives her response verbally (step 116) to each question, and each response is compared to the response written down on the back of the corresponding Group 1 answer card by her A teammate in the open forum round (step 118). If the B teammate's response is a match, the team scores one or more points (step 119), for example by taking a token 20 and putting it in their collection dish 22. If the B teammate's response does not match, no points are scored for that question.

Figure 7:
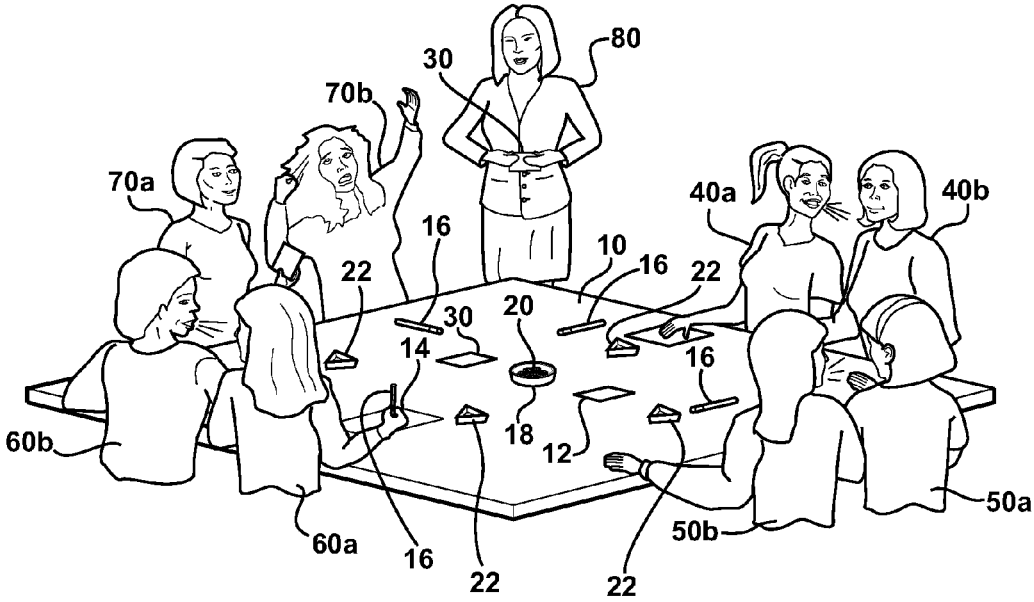
FIG. 7 is similar to FIG. 6, but shows the excused teammates giving their responses one at a time to a second-round question.

Referring next to FIGS. 1A and 7, once the B teammates have responded to all of the Group 1 questions, and their responses have been compared to their A teammates' responses to those same questions, and scores recorded (by taking tokens 20, for example), the B teammates are next asked the Group 2 question at steps 120*a* and 120. This answer round differs from the previous answer round at steps 116-118, in that one of the teammate divisions (the A's or the B's—the A's in the preferred method) is instructed not to reveal their responses to the group unless their teammates' responses are a match. The other teammates (the B's in the preferred method) accordingly announce their responses one at a time (step 120). For example, referring to team 70 in FIGS. 6 and 7, if the B teammate 70*b*'s response is a match to her A teammate 70*a*'s response (step 122), the team scores bonus points (step 123). If the response is not a match, each of the other teams 40, 50, and 60 can privately huddle or consult (40*a* with 40*b*, 50*a* with 50*b*, 60*a* with 60*b*) and quietly discuss ("whisper") what a matching response might be (step 124). Each team then writes down its response on a corresponding "team whisper bonus" answer card 14 (preferably a separate card), without letting the other teams see the response. The reader will reread the question, each team will reveal their team's response one at a time, and then the A teammate 70*a* whose response wasn't matched by her B teammate 70*b* reveals her response to the group (step 126). Those teams whose responses match A teammate 70*a*'s response receive a bonus score (step 127). The procedure is then repeated (step 128) with the other teams: the next team's B teammate announcing her response to the question, her A teammate privately comparing her B teammate's response to her own previously-written response to the question, and the team scoring bonus points if they match; if they don't match, allowing the other teams to come up with a matching response in private "whisper" conference, until all teams are done.

The preferred method of playing the "closed forum" round of play, as briefly mentioned above, is to have the B teammates announce their responses, and the A teammates privately compare and keep their responses secret for a possible "whisper bonus" attempt by the other teams, unless their B teammates' responses are a match. It is also possible to reverse this order, by having the A teammates announce their responses to the Group 2 question while the B teammates privately compare and hold their responses in reserve for a possible "whisper bonus" by the other teams.

The choice as to which of the A and B teammates announces her response to the Group 2 question and which privately compares and keeps her unmatched response in reserve for a "whisper bonus" might be affected by the object of the question. For example, in the most preferred form of play, the Group 2 question asks something about the A teammate herself; her response is best termed an "answer", and when her B teammate returns and is presented with the same Group 2 question, her response is best termed a "guess" as to how her A teammate answered the question about herself; B then preferably announces her "guess", and A privately compares and keeps her unmatched "answer" secret. Alternately, the Group 2 question can be similar to the Group 1 question, in that it asks something about the B teammate who is absent from the room, so that the A teammate's response is best termed a "guess" as to how the B teammate will answer the question about herself.

For a first alternate example of play, after the reader reads the Group 2 question, the A teammate 70*a* writes her answer on her answer card. The B teammate 70*b* returns but instead of announcing her guess, the B teammate 70*b* will write her guess on a separate piece of paper, keeping it hidden from all others. The A teammate 70*a* then reveals her answer; if it is a match, the team scores bonus points; if it is not a match, the B teammate 70*b*'s guess is not revealed, and the other teams get one chance to quietly discuss ("whisper") what a matching guess might be. Each team then writes down their guess on a corresponding "team whisper bonus" answer card, without letting the other teams see their guess. The reader will reread the question, each team will reveal their team's response one at a time, and then B teammate 70*b* whose guess wasn't a match to her A teammate 70*a*'s answer, reveals her guess to the group. Those teams whose guesses match B teammate 70*b*'s guess receive a bonus score. The procedure is then repeated with the other teams.

For a second alternate example of play, the reader phrases the Group 2 question so the A teammate 70*a* must guess how her B teammate 70*b* will answer (same as in the open forum round with Group 1 questions). The B teammate 70*b* returns and announces her answer; if it is a match, the team scores bonus points; if it is not a match, the A teammate 70*a*'s guess is not revealed, and the other teams get one chance to quietly discuss ("whisper") what a matching guess might be. Each team then writes down their guess on a corresponding "team whisper bonus" answer card, without letting the other teams see their guess. The reader will reread the question, each team will reveal their team's response one at a time, and then A teammate 70*a* whose guess wasn't a match to her B teammate 70*b*'s answer, reveals her guess to the group. Those teams whose guesses match A teammate 70*a*'s guess receive a bonus score. The procedure is then repeated with the other teams.

For a third alternate example of play, the reader phrases the Group 2 question so the A teammate 70*a* must guess how her B teammate 70*b* will answer. The B teammate 70*b* returns but instead of announcing her answer, she will write her answer on a separate piece of paper (not provided), keeping it hidden from all others. The A teammate 70*a* then reveals her guess and if it is a match, the team scores bonus points. If it is not a match, the B teammate 70*b*'s answer is not revealed, and the other teams get one chance to quietly discuss ("whisper")

what a matching answer might be. Each team then writes down their guess on a corresponding "team whisper bonus" answer card, without letting the other teams see their guess. The reader will reread the question, each team will reveal their team's response one at a time, and then B teammate 70*b* whose answer wasn't matched by her A teammate 70*a*' guess, reveals her answer to the group. Those teams whose guesses match B teammate 70*b*'s answer receive a bonus score. The procedure is then repeated with the other teams.

Similar variations, such as those listed above, are also possible and within the scope of the invention and could be applied for presenting the Group 1 questions and for playing the open-forum round of questions.

Once the "whisper bonus" round at steps 120-128 is finished, the game can now either end and proceed to steps 130 and 132, or it may continue, in the preferred form the A teammates next being isolated (at step 104), and steps 106-128 being repeated with the B teammates taking the A teammates' place. Steps 104-128 can also be repeated more than one time, with each A-B division having multiple turns before the game is completed. However many A-B division turns are taken, scores from all rounds are finally tallied (step 130), and the team with the highest score (most points, most tokens, etc.) wins, and may announce their win with an appropriate celebratory phrase or action. It will be understood that the manner of keeping score can vary, and is not limited to collecting tokens in the manner illustrated, or to any particular points-based system, although the illustrated point-value tokens are preferred. Other scoring methods are possible.

The game can also be played in simplified form by two or more players individually, instead of in teams. This form of play is not preferred, but is merely presented as an option if there are not enough players for team play.

In individual play, assuming four players for example, a first player selects a Group 1 question card from the top of deck 12, and reads the question aloud with reference to herself ("Am I wearing nail polish on my toenails right now?"). Then she and all the other players write their answers down privately on the backs of their dry-erase answer cards 14. The first player then re-reads the question and the other players then reveal their guesses as to her answer, preferably one at a time. Any of the other players who match the first player's answer wins a point or scores by collecting a token 20 and placing it in her collection tray 22; the first player gets a point or scores only if none of the other three players matches her answer. This procedure is then repeated around the table for the remaining three players, one Group 1 question per player each time around, as many rounds as desired, with the preferred method being a total of four Group 1 questions per player in a total of four rounds. The players can also each read Group 2 questions, with the preferred method being one Group 2 question per player, but they would function similarly to Group 1 questions since there are no teams, a correct guess wins a point and incorrect guesses would simply earn no score; the first player gets bonus points beyond the points scored for the Group 1 questions only if none of the other three players match her answer. This procedure is then repeated around the table for the remaining three players.

During individual play as described above, each player can use a single erasable answer card 14, with answers wiped off between questions.

The game preferably comes with pre-written question card sets 12 and 30. The game can be customized by a hostess prior to play, for example by selecting which types of questions are most appropriate or entertaining or comfortable for a given group of players. Some groups might prefer or be more comfortable with more intimate or "risque" questions, others might prefer questions that are less so. It would also be possible for a hostess to make her own question cards, or even to allow a reader to spontaneously make up questions for an open-forum round and/or a closed-forum round. As with most card-based question games, the purchaser could be offered the option of buying additional sets of question cards for more variety over the long term.

It will finally be understood that the disclosed embodiments are representative of presently preferred forms of the invention, but are intended to be illustrative rather than definitive of the invention, and that reasonable variations and modifications are possible within the scope of the invention. The scope of the invention is defined by the following claims.

What is claimed is:

1. A question and answer game method for entertaining and socializing a party of people at least some of whom are relatively unknown or unequally known to each other, by testing them openly to see how well pairs of people matched at the party know each other and thus teaching all members of the party something about the individuals in each pair, and further by creating competitive bonding between matched pairs of people as against other members of the party, thereby "breaking the ice", increasing knowledge of one another, and creating a greater social bond among members of the party, comprising:

selecting teams comprising two persons from a party of people at least some of whom are relatively unknown or unequally known to each other;

designating a first person on each team as an A teammate, and designating a second person on each team as a B teammate;

providing a set of predetermined questions on one or more tangible presenting media, the questions designed to determine how well A and B teammates know each other, the set of questions comprising a Group 1 question and a Group 2 question;

isolating the B teammates from their A teammates and the party;

presenting the Group 1 question to the A teammates, the A teammates responding to the Group 1 question in an open forum, and recording their responses on one or more tangible recording media in a manner hidden from their B teammates;

presenting the Group 2 question to the A teammates, the A teammates responding to the Group 2 question in a closed forum by recording their responses on the recording media in a manner hidden from their B teammates and from the other A teammates;

bringing the B teammates back from isolation into communication with their A teammates and the party, asking the B teammates the Group 1 question from the presenting media, the B teammates giving their respective responses to the Group 1 question openly, revealing and comparing the A teammates' responses from the recording media to their B teammates'open responses in a manner open to the other teams, and giving a score for matching responses;

asking the B teammates the Group 2 question from the presenting media, the B teammates giving their respective responses to the Group 2 question, a first one of the A and B teammates of a first team giving her response to the Group 2 question from the recording media, comparing the second teammate's response to the first teammate's response and revealing the second teammate's response to the other teams if the responses match, and giving a score therefor, but otherwise keeping the second teammate's response hidden from the other teams and giving the other teams in the party a chance to privately consult, to record their responses on the recording media in a manner hidden from the other teams, to reveal their recorded responses one team at a time in an open manner, and then to reveal the second teammate's recorded response in an open manner to all, and giving a score to any team whose recorded response matches that of the second teammate's response.

2. The method of claim 1, wherein the step of the A teammates discussing their responses in an open forum how the B teammates will respond to the Group 1 question permits the A teammates to discuss information relevant to their responses with the other A teammates.

3. The method of claim 1, wherein the step of the A teammates recording their responses to the Group 2 question in a closed forum does not permit the A teammates to discuss information relevant to their responses with the other A teammates.

4. The method of claim 3, wherein during the step of the A teammates recording their responses to the Group 2 question in a closed forum, the A teammates are not permitted to talk.

5. The method of claim 1, wherein during the steps of the B teammates giving their responses to the Group 2 questions the B teammates are not otherwise permitted to talk.

6. The method of claim 1, wherein the Group 2 question is taken from a different set of questions.

7. The method of claim 1, wherein the step of the first teammate revealing her response to the Group 2 question comprises the step of the B teammate revealing her response to the group in an open manner, and the step of comparing the second teammate's response to the first teammate's response to the Group 2 question comprises the step of the A teammate secretly comparing her recorded response to the B teammate's revealed response.

8. The method of claim 7, wherein the Group 2 question requires the B teammate to guess how her A teammate has answered.

9. The game method of claim 7, wherein the Group 2 question requires the A teammate to guess how her B teammate will answer.

10. The method of claim 1, wherein the step of the first teammate revealing her response to the Group 2 question comprises the step of the A teammate revealing her recorded response to the group in an open manner, and the step of comparing the second teammate's response to the first teammate's response to the Group 2 question comprises the step of the B teammate secretly comparing her recorded response to the A teammate's revealed response.

11. The method of claim 10, wherein the Group 2 question requires the A teammate to guess how her B teammate will answer.

12. The method of claim 10, wherein the Group 2 question requires the B teammate to guess how her A teammate has answered.

13. The method of claim 1, wherein when the other teams in the party privately consult they form separate team huddles, and may not discuss their response with anyone other than their respective teammates.

* * * * *